United States Patent [19]

Iimuro et al.

[11] Patent Number: 5,010,834

[45] Date of Patent: Apr. 30, 1991

[54] CLUTCH TYPE ROLLER FEED FOR A SEWING MACHINE NEEDLE THREAD

[75] Inventors: Ikuro Iimuro, Sagamihura; Toshiki Matsushita; Toshihiro Furuya, both of Chofu, all of Japan

[73] Assignee: Juki Corporation, Chofu, Japan

[21] Appl. No.: 262,710

[22] Filed: Oct. 26, 1988

[30] Foreign Application Priority Data

Oct. 31, 1987 [JP] Japan ..... 62-276464
Jun. 30, 1988 [JP] Japan ..... 63-164613

[51] Int. Cl.[5] ..... D05B 49/04

[52] U.S. Cl. ..... 112/302; 112/278; 112/322; 226/37; 226/152; 139/452

[58] Field of Search ..... 226/37, 152, 188, 181; 74/813 C, 814; 112/302, 278, 322; 139/452; 66/132; 474/18

[56] References Cited

U.S. PATENT DOCUMENTS 3,962,891 6/1976 Rouzaud ..... 66/132 R
4,221,317 9/1980 Fukada et al. ..... 226/188
4,408,554 10/1983 Takiguchi et al. ..... 112/302
4,566,396 1/1986 Sakuma et al. ..... 112/302
4,649,844 3/1987 Matsubara ..... 112/302
4,766,827 8/1988 Matsubara ..... 112/302 X

*Primary Examiner*—Andrew M. Falik
*Attorney, Agent, or Firm*—Morgan & Finnegan

[57] ABSTRACT

A needle thread feeding assembly in which the thread is positively fed at a desired stitch pitch while being clamped in between a presser roller and a drive roller, whose rotation is frictionally transmitted from a drive source. An encoder detects a predetermined amount of rotation and signals to restrict the drive roller, while allowing the drive shaft to continue rotating. A main-shaft-angle-detector detects predetermined angles adapted to operate the required stitch pitch and to start counting of pulses at the encoder. When a required number of pulses corresponding to the stitch-pitch is counted, the encoder signals to restrict the drive roller. Thus, the needle thread is positively and intermittently fed according to the stitch pitch.

14 Claims, 8 Drawing Sheets

START
INITIALIZED
MAIN SHAFT PHASE ANGLE 110° ?
NO
YES
STEP 1
READ INFORMATION ZIGZAG WIDTH STITCH PITCH WORKPIECE THICKNESS
STEP 2
OPERATE REQUIRED THREAD LENGTH PER STITCHING
STEP 3
MAIN SHAFT PHASE ANGLE 85 ?
NO
YES
STEP 4
DEENERGIZE SOLENOID 39
STEP 5
ROLLER32 ROTATED FOR REQUIRED THREAD LENGTH ?
NO
YES
STEP 6
ENERGIZE SOLENOID 39
STEP 7

CLUTCH TYPE ROLLER FEED FOR A SEWING MACHINE NEEDLE THREAD

BACKGROUND OF THE INVENTION

This invention relates to a needle thread feeding mechanism which positively feeds the required length of needle thread per stitching, such that well-balanced stitchings are obtained.

Referring to FIG. 8, one conventional type of thread feeding mechanism will be explained. FIG. 8 is taken from U.S. Pat. No. 4,566,396 entitled, "Thread Feed Mechanism in Sewing Machine." In such a device, a thread T is arranged to pass through two solenoids 56, 57. Solenoids 56, 57 are adapted to hold the thread T when energized.

Between the solenoids 56, 57 is a paying-out lever 62. The lever lifts the thread T in association with main shaft rotation such that the thread T is fed when the first solenoid 56 is off and the second solenoid 57 is on. Solenoids 56, 57 act alternately such that when one is off, the other is on.

A roller 65 is connected to a pulse generator (not shown) such that thread length is detectable as it is fed. When the required length of thread T is detected, the first solenoid 56 turns on and the second solenoid 57 turns off such that the thread T is fed to the needle.

The motion of the paying-out lever 62, take up lever 55, and needle 52 are synchronized. Timing for the on-off action of solenoids 56 and 57 is set at 85 degrees of the main shaft phase angle, the phase angle at which thread slackening by the take-up lever begins. The thread T is fed positively and intermitently by the required pitch length by repeating the above-mentioned on-off control of solenoids 56, 57, as set forth in U.S. Pat. No. 4,566,396.

In such prior art, thread passage is very complicated because there are many turnbacks and right-turns and passage through two solenoids. Simpler passage is desirable.

Another conventional way of feeding thread is through the use of a step motor to control the required length of feed But where the stitching speed is high, the step motor may not work accurately in response to the pulse signals. In addition, a step motor adds considerable cost.

SUMMARY OF THE INVENTION

The disadvantages of the prior thread feeding mechanisms are overcome with an apparatus according to the present invention. The invention provides a thread feed roller which is driven by a drive source, through a frictional force, with a restrictor to hold and release the roller. The feed roller stops, when restricted, while the drive shaft continues to rotate by slipping around the inside shaft hole of the feed roller. When the restriction is released, the drive source drives the feed roller by friction. The friction force is adjusted to enable the aforementioned mechanical motion. The invention provides a means for detecting the feed length of the thread by detecting the rotation of the feed roller. The detecting means activates the restricting mechanism when the detecting means determines that the desired stitch pitch length has been achieved.

BRIEF DESCRIPTION OF THE DRAWINGS

The invention is described in greater detail below by way of reference to the following drawings, in which.

DETAILED DESCRIPTION OF THE DRAWINGS

Figure 1:
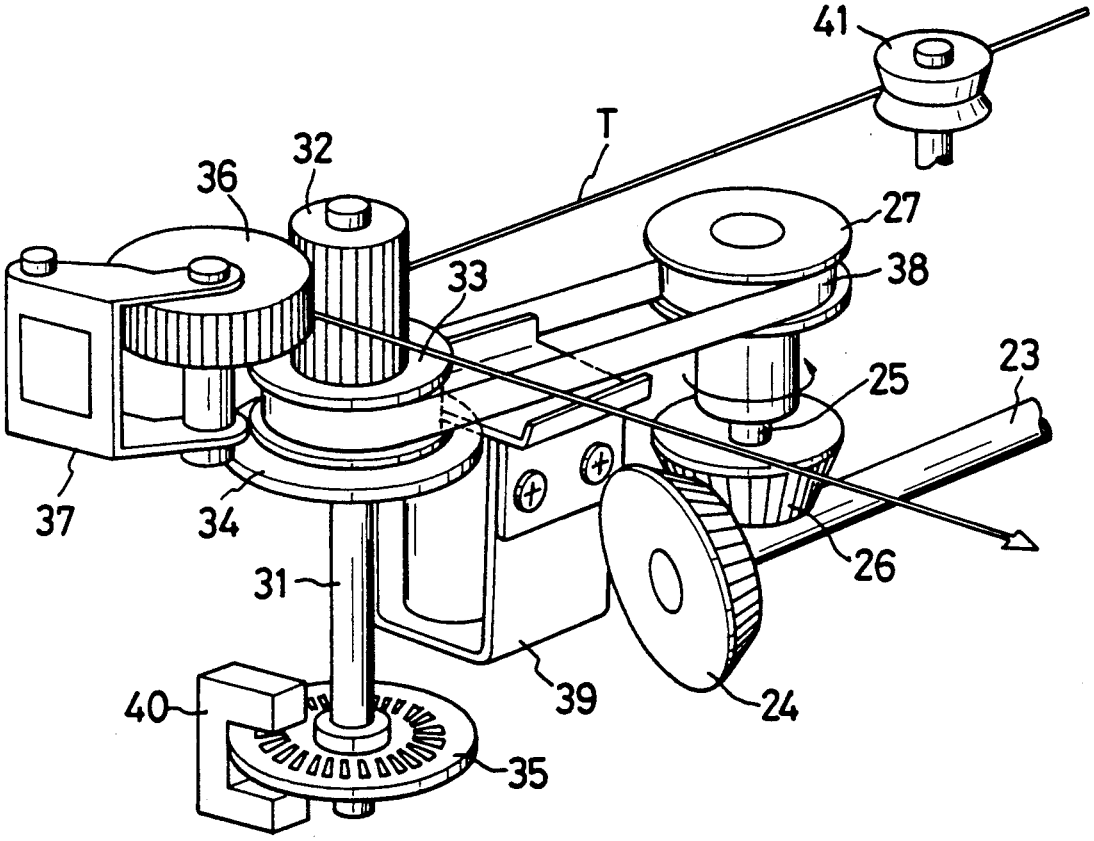
FIG. 1 is a perspective view of a thread feeding mechanism according to the present invention.
Figure 2:
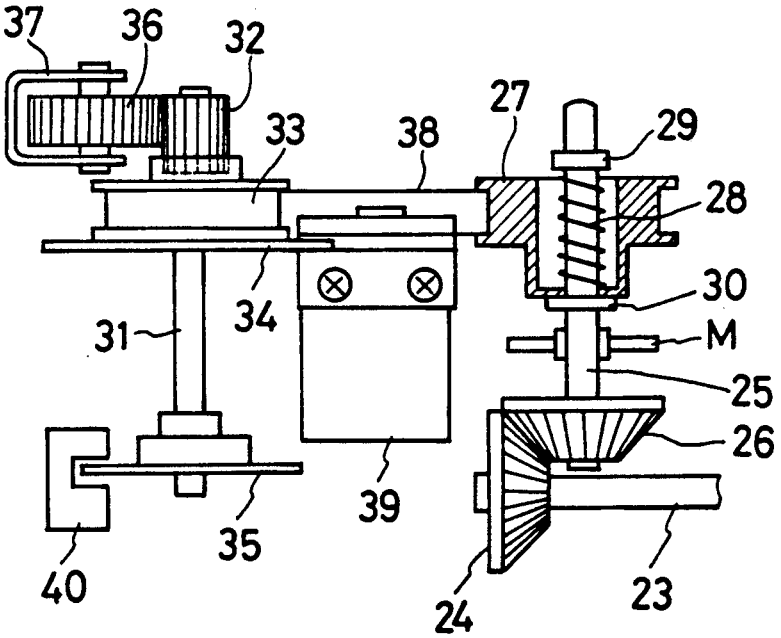
FIG. 2 is a partial side view of FIG. 1.

Referring to FIG. 1 and FIG. 2, one preferred embodiment of the present invention will be explained. In the preferred embodiment, a bevel gear 24 is fixed to a main shaft 23. A drive shaft 25 is sustained by a machine frame M and is rotated by a bevel gear 26 which meshes with the bevel gear 24.

A first pulley 27 loosely receives therethrough the drive shaft 25. A biased spring 28 is capped on the drive shaft 25 with one end in contact with an adjustable nut 29 and the other end resting on the bottom surface of the first pulley 27, such that the bottom surface of the first pulley 27 rotates frictionally with a flange 30 of the drive shaft 25.

The upper portion of the drive shaft 25 is threaded to receive the adjustable nut 29 such that the rotation of the adjustable nut controls the friction force between the first pulley 27 and the drive shaft 25. Thus, the first pulley 27, the spring 28, the adjustable nut 29, and the flange 30 constitute a clutching assembly.

Numeral 31 denotes a rotatable shaft sustained by the machine frame. A roller 32, a second pulley 33, a brake disc 34 and a slit disc 35 are fixed coaxially to the rotatable shaft 31. A presser roller 36 is sustained by a frame 37 which is fixed to the machine frame. The presser roller 36 is urged against the roller 32 by a spring (not shown). The roller 32 consists preferably of a hard material such as a metal or ceramic, and has a contact surface which is knurled. The presser roller 36 is preferably made of a soft material such as rubber or plastic.

Numeral 38 denotes a timing belt which connects the first pulley 27 and the second pulley 33. The timing belt 38 transmits the rotation of the first pulley 27 to the second pulley 33.

A solenoid 39 restricts (in its on condition) and releases (in its off condition) the brake disc 34. The activation and operation of solenoid 39 will be discussed in greater detail below.

Numeral 40 denotes a photo-interupter which is positioned to detect the slit disc 35. A constant tension is provided to thread T by base thread tension 41.

In this embodiment, the drive shaft is driven by the main shaft 23. An alternative embodiment could include a different drive source for the drive shaft, such as an electric motor.

Figure 3:
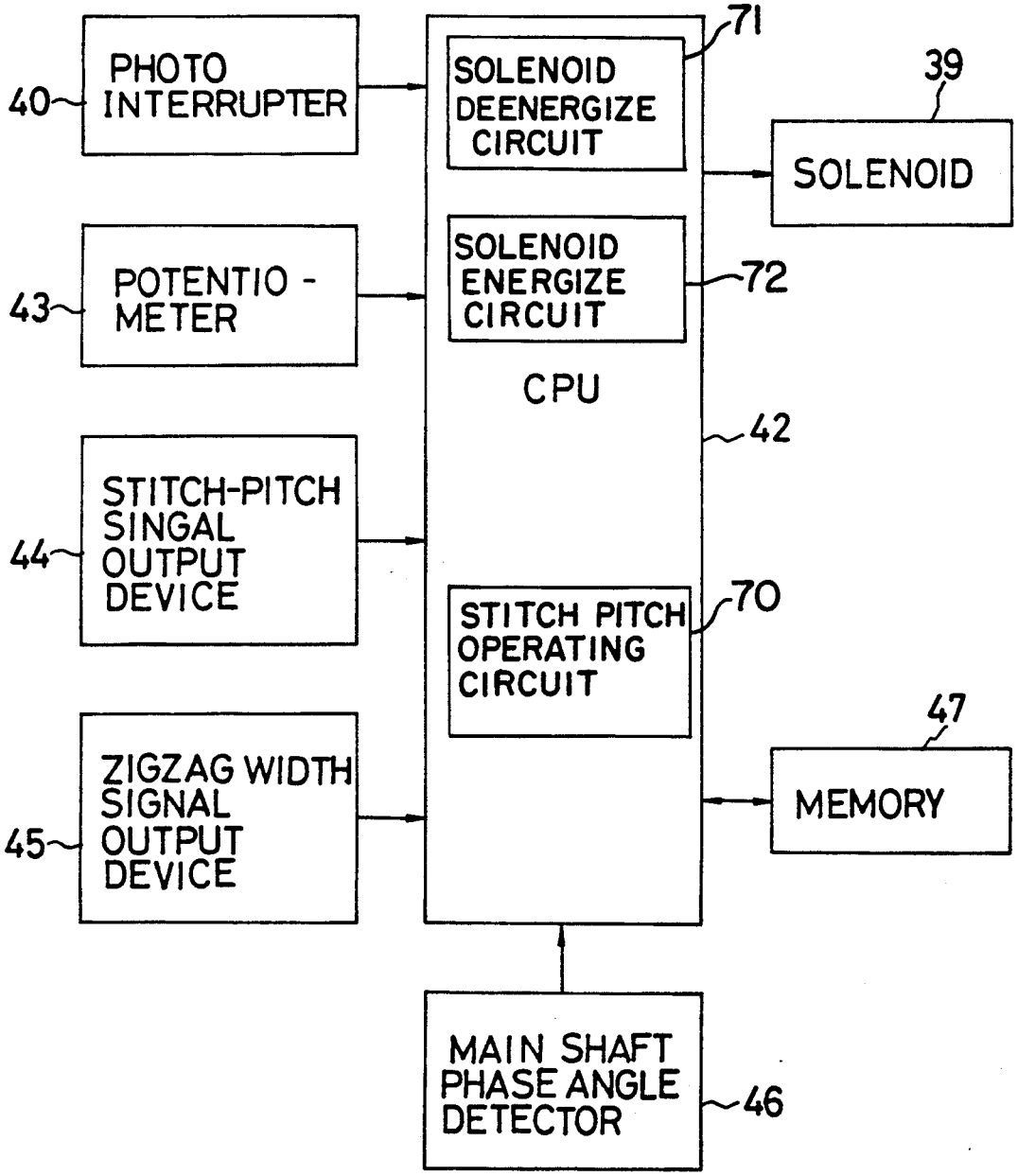
FIG. 3 is a control block diagram of a thread feeding mechanism according to the present invention.

FIG. 3 shows a control block diagram according to the present invention. A potentiometer 43 detects the height of the needle bar in order to determine the thickness of the workpiece. The value detected by the potentiometer is input to CPU 42. A stitch-pitch-signal output device 44 detects the stitch pitch setting, manually input by an operator, and transmits the setting to CPU 42. A zigzag-width-signal output device 45 transmits its width value, manually input by an operator, to CPU 42.

A main-shaft-phase-angle detector 46 detects the phase angle of main shaft 23. When the needle is positioned at its highest point, the phase angle is set as zero degrees. When the needle is positioned at its lowest point, the phase angle is set as 180° degrees. Detection signals are also sent at phase angles of 85° and 110° degrees.

The CPU 42 receives input from potention meter 43, stitch-pitch-signal output device 44, zigzag-width-signal output device 45, photo-interupter 40 and main-shaft-phase-angle detector 46. The CPU 42 operates to control the solenoid 39.

Figure 4:
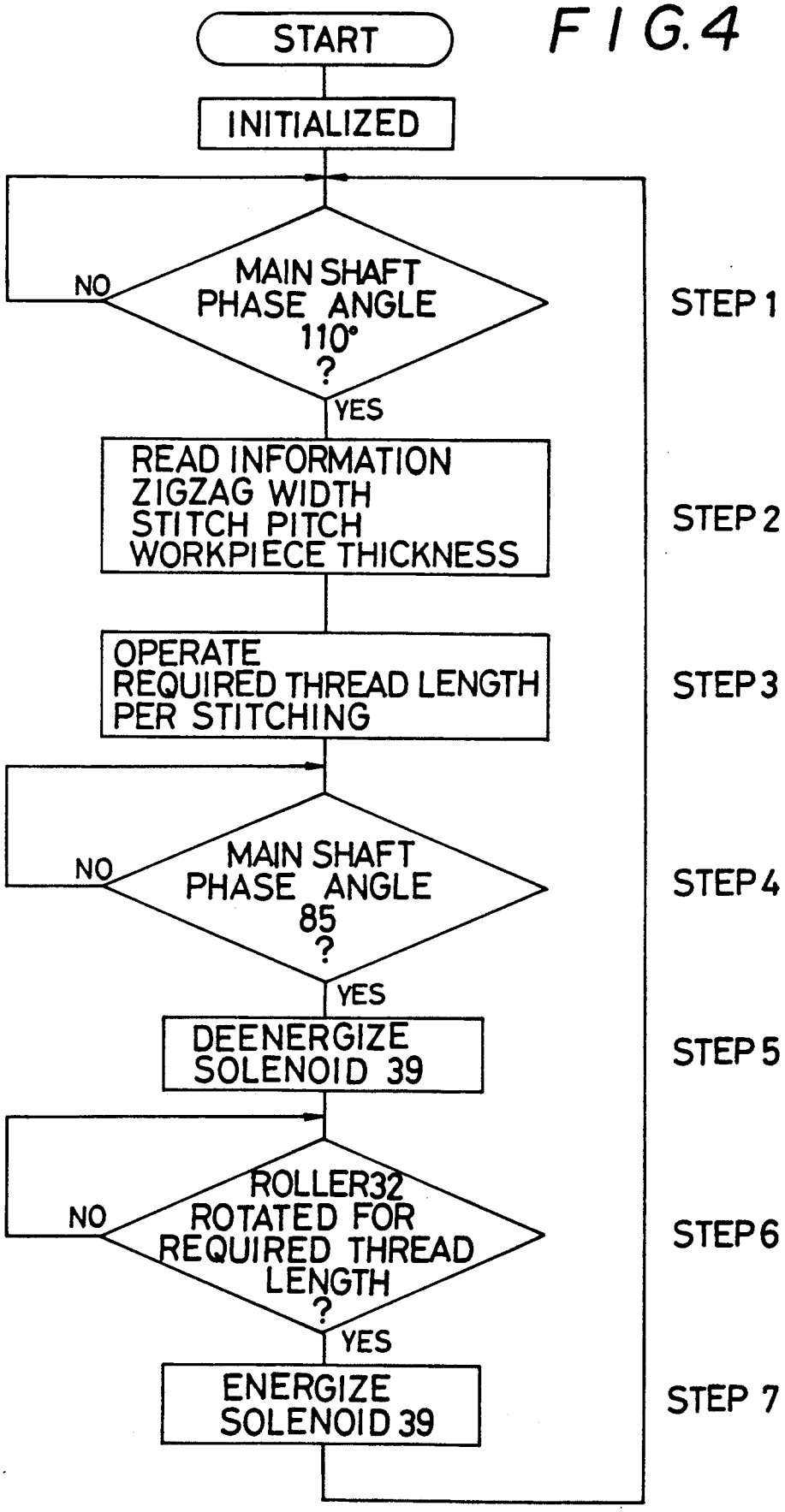
FIG. 4 is a flow chart of a thread feeding mechanism according to the present invention.
Figure 5:
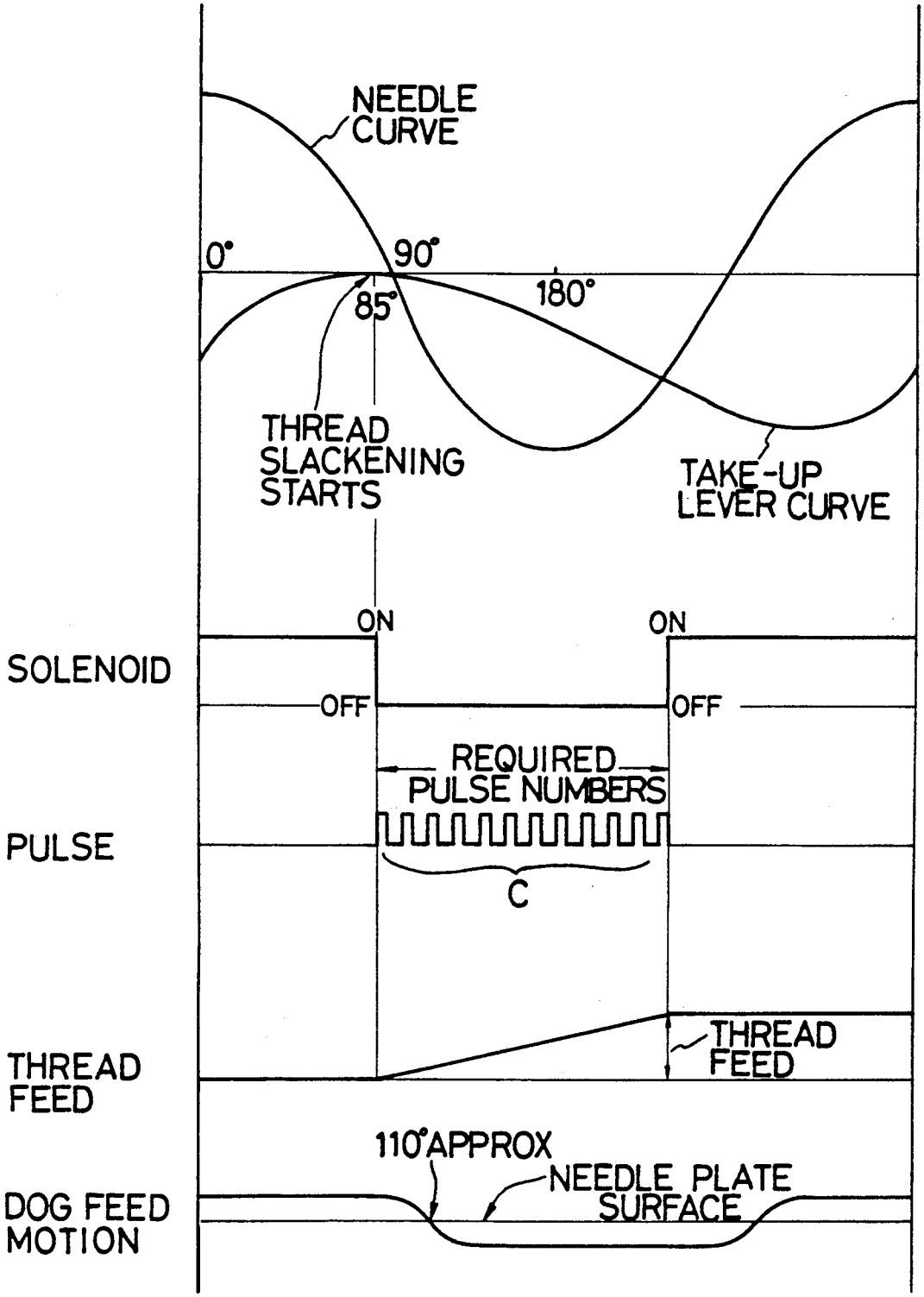
FIG. 5 is a timing chart of a thread feeding mechanism according to the present invention.

FIG. 4 illustrates an operational flow chart and FIG. 5 illustrates an operational timing chart. Referring to these figures, the operation of an embodiment can be described. When roller 32 starts rotating, CPU 42 determines an initial setting. When the main-shaft-phase-angle detector 46 detects 110 degrees, the stitch pitch data, zigzag width data, and workpiece thickness data (measured by the potentiometer 43) are input to CPU 42 (steps 1 and 2). Workpiece thickness is preferably measured at 110 degrees, where the surface of the dog feed sinks slightly under the needle plate. Based on the above data, the stitch pitch is determined and input into memory 47 (step 3).

When the main-shaft-phase-angle detector 46 detects 85 degrees, the solenoid 39 is deenergized by a circuit 71 in the CPU 42. This condition is set because at 85 degrees, the thread slackening action of the take-up lever starts (step 4). Next, first pulley 27 rotates since the brake disc 34 is released from the solenoid 39.

While solenoid 39 is energized, rotation of the rotatable shaft 31 and the second pulley 33 are stopped but the drive shaft 25 continues rotating even though belt 38 and the first pulley 27 are stopped because the friction force between the flange 30 and the first pulley 27 is overcome by the rotational force of the drive shaft 25.

As the solenoid 39 is deenergized (step 5), the second pulley 33 will be driven via belt 38 by the first pulley 27, which rotates because of the friction between the first pulley 27 and the flange 30. The rotatable shaft 31, roller 32, presser roller 36 and the slit disc 35 rotate simultaneously. Since the thread T is clamped between the roller 32 and the presser roller 36, the thread T is fed to the take-up lever. A circuit 70 operates a desired stitch pitch when the main-shaft-phase-angle detector 46 detects a predetermined angle.

Figure 7:
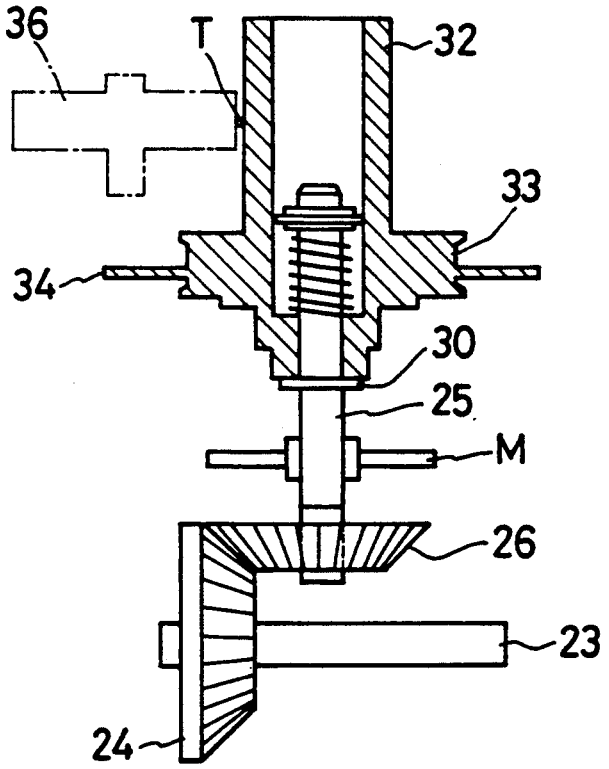
FIG. 7 is a partial detail drawing of another embodiment of the present invention.
Figure 8:
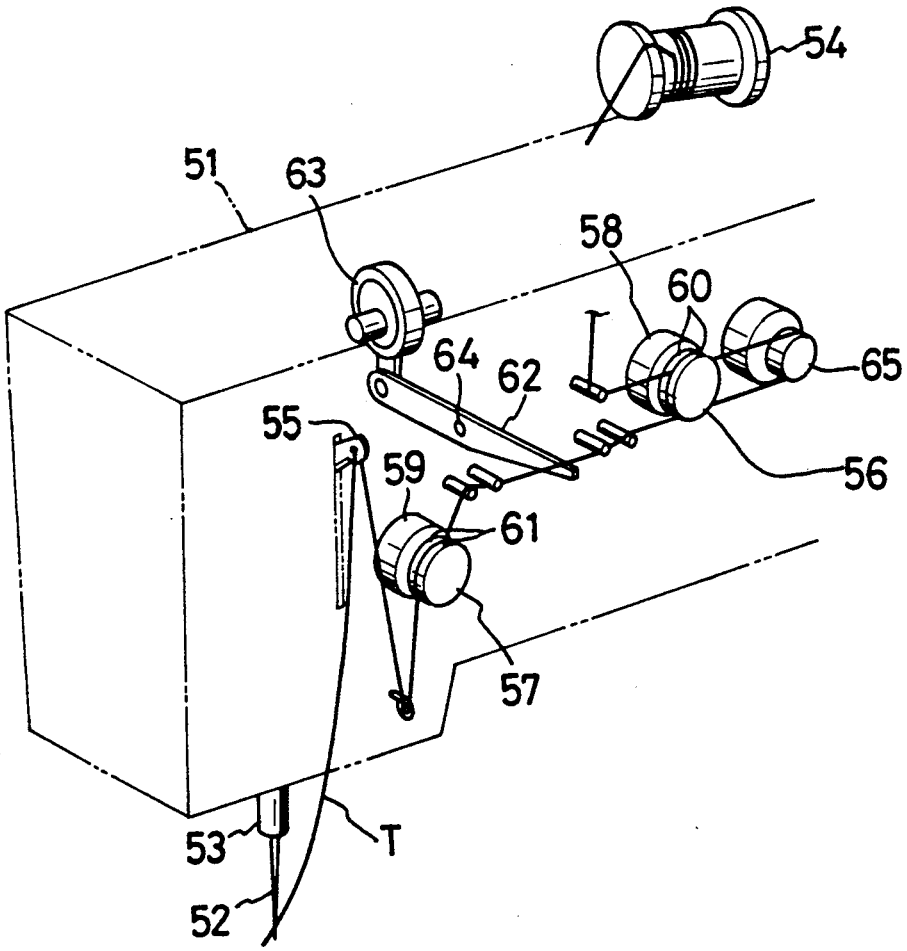
FIG. 8 PRIOR ART
FIG. 8 is a perspective view drawing of a thread feeding mechanism according to the prior art.

As the slit disc 35 rotates, the photo-interupter 40 transmits a signal as shown at C in FIG. 5. The CPU 42 counts pulse numbers and when it has counted pulse numbers corresponding to the required stitch pitch (step 6) as previously determined (at step 3), a circuit 72 in the CPU 42 energizes the solenoid 39 (step 7). When energized, the solenoid 39 restricts brake disc 34 so that roller 32 stops, causing thread T to stop, while allowing the drive shaft 25 to continue to rotate In this embodiment, the rotatable shaft 31 is provided beside the drive shaft 25, and roller 32 is fixed to the rotatable shaft 31. However, it is possible to fix the roller 32 to the drive shaft 25 with a frictional connection similar to the assembly including the first pulley 27 and drive shaft 25. Under such a construction, first pulley 27, second pulley 33, timing belt 38 and rotatable shaft 31 would be eliminated. Such a mechanism is shown in FIG. 7.

Figure 6:
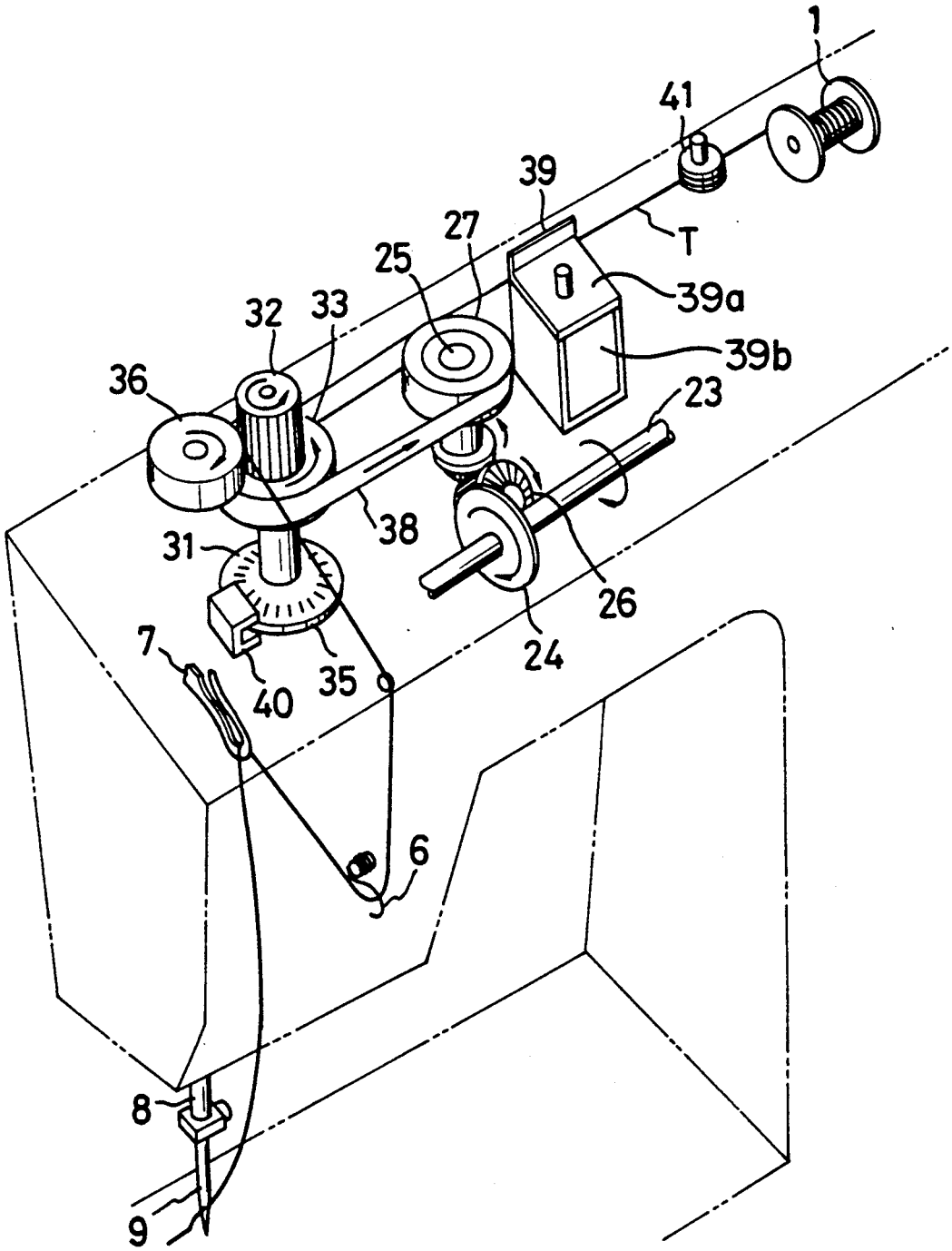
FIG. 6 is a perspective view of another embodiment of the present invention.

FIG. 6 is a perspective view of an alternate embodiment. In the embodiment described in detail above, the solenoid 39 restricts the brake disc 34. In the alternative embodiment of FIG. 6, the solenoid 39 is located between base thread tension 41 and roller 32. When energized, solenoid 39 directly restricts thread T, for example, by clamping thread T between an upper movable plate 39*a* and a lower fixed portion 39*b*. When the thread T is restricted, the roller 32 and the driven roller 36 stop because thread T is clamped between these two rollers and will act like a brake shoe since the thread T does not move. In other words, when the thread T ceases moving, the friction force between the thread and the roller 32 overcomes the drive force transmitted by the belt 38 to stop the rollers 32 and 36. Thus, the rotatable shaft 31 stops, and, as a result, the first pulley 27, second pulley 33, and belt 38 stop, but the drive shaft 25 continues to rotate since its mechanical construction of using fricition between the shaft 32 and the pulley 27 are the same as in the preferred embodiment shown in FIGS. 1 and 2.

Thus, according to the present invention, the solenoid restrictor works when the encoder detects that thread T has been fed the required stitch pitch and well-balanced stitchings are obtained. The required stitch pitch is operated whenever the main shaft phase angle reaches the predetermined angle such that when the thickness of the workpiece is varied, a well-matched length of thread will automatically be fed, and well-balanced stitchings will be performed.

As many apparently widely different embodiments of the invention may be made without departing from the spirit and scope therein, it is to be understood that the invention is not limited to the specific embodiments described herein and should be interpreted only in accordance with the claims which follow.

We claim:

1. A needle thread feeding mechanism, comprising:

(a) a drive source including a drive shaft, a first pulley, means for allowing said first pulley to loosely receive said drive shaft therethrough, and connect means for frictionally connecting said first pulley to said drive shaft;

(b) thread drawing means including a driven shaft, a drawing roller for drawing needle thread from a spool, and a second pulley, said drawing roller and said second pulley being fixed to said driven shaft;

(c) a belt for transmitting the rotation of said first pulley to said driven shaft;

(d) detecting means for detecting the rotation of said drawing roller to generate a signal; and (e) disconnect means responsive to said detected signal for drivingly disconnecting said first pulley from said drive shaft.

2. A needle thread feeding mechanism as recited in claim 1, wherein said connect means includes a flange portion extended from said drive shaft and a spring urging said first pulley against said flange portion, said first pulley frictionally contacting said flange portion.

3. A needle thread feeding mechanism, as recited in claim 1, wherein said disconnect means comprises:

(f) a brake disc provided on the drawing roller;

(b) a solenoid which operates to brake said brake disc;

(h) a circuit to deenergize said solenoid when the detecting means detects a predetermined phase angle of the main shaft; and (i) a circuit to energize said solenoid when the detecting means detects the rotation of the drawing roller corresponding to an operated stitch pitch.

4. A needle thread feeding mechanism, as recited in claim 1, in which said detecting means comprises:

(f) an encoder provided coaxially with the shaft of the roller;

(g) potentiometer which detects the thickness of a workpiece;

(h) a micro computer having a central processing unit and a memory unit;

(i) a zigzag-width-signal-output device which outputs zigzag width to said central processing unit;

(j) a stitch-pitch-signal-output device which outputs a stitch pitch signal to said central processing unit;

(k) a main-shaft-phase-angle detector which detects phase angle of the main shaft; and (l) a circuit to operate a desired stitch pitch when said main-shaft-phase-angle detector detects a predetermined angle.

5. A needle thread feeding mechanism, comprising:

(a) a drive source including a drive shaft, a first pulley, means for allowing said first pulley to loosely receive said drive shaft therethrough, and connect means for frictionally connecting said first pulley to said drive shaft;

(b) thread drawing means including a driven shaft, a drawing roller for drawing needle thread from a spool, and a second pulley, said drawing roller and said second pulley being fixed to said driven shaft;

(c) detecting means for detecting the rotation of said drawing roller to generate a signal; and (d) disconnect means for holding said second pulley, in response to said detected signal, to drivingly disconnect said first pulley from said drive shaft.

6. A needle thread feeding mechanism as recited in claim 5 wherein said thread drawing means further includes a presser roller associated with said drawing roller for clamping the needle thread therebetween.

7. A needle thread feeding mechanism as recited in claim 6, wherein said connect means includes a flange portion extended from said drive shaft, and a spring urging said first pulley against said flange portion, said first pulley frictionally contacting said flange portion.

8. A needle thread feeding mechanism, as recited in claim 5, wherein said disconnect means comprises:

(f) a brake disc provided on the drawing roller;

(g) a solenoid which operates to brake said brake disc;

(h) a circuit to deenergize said solenoid when the detecting means detects a determined phase angle of the main shaft; and (i) a circuit to energize said solenoid when the detecting means detects the rotation of the drawing roller corresponding to an operated stitch pitch.

9. A needle thread feeding mechanism, as recited in claim 5, in which said detecting means comprises:

(f) an encoder provided coaxially with the shaft of the roller;

(g) a potentiometer which detects the thickness of a workpiece;

(h) a micro computer having a central processing unit and a memory unit;

(i) a zigzag-width-signal-output device which outputs zigzag width to said central processing unit;

(j) a stitch-pitch-signal-output device which outputs a stitch pitch signal to said central processing unit;

(k) a main-shaft-phase-angle detector which detects phase angle of the main shaft; and (l) a circuit to operate a desired stitch pitch when said main-shaft-phase-angle detector detects a predetermined angle.

10. A needle thread feeding mechanism, comprising:

(a) a drive source including a drive shaft, a first pulley, means for allowing said first pulley to loosely receive said drive shaft therethrough, and connect means for frictionally connecting said first pulley to said drive shaft;

(b) thread drawing means including a driven shaft, a drawing roller for drawing needle thread from a spool, and a second pulley, said drawing roller and said second pulley being fixed to said driven shaft;

(c) a belt for transmitting the rotation of said first pulley to said driven shaft;

(d) detecting means for detecting the rotation of said drawing roller to generate a signal; and (e) disconnect means for directly holding said needle thread, in response to said detected signal, when said first pulley is drivingly disconnected from said drive shaft.

11. A needle thread feeding mechanism as recited in claim 10, wherein said thread drawing means further includes a presser roller associated with said drawing roller for clamping the needle thread therebetween.

12. A needle thread feeding mechanism as recited in claim 11, wherein said connect means includes a flange portion extended from said drive shaft, and a spring urging said first pulley against said flange portion, said first pulley frictionally contacting said flange portion.

13. A needle thread feeding mechanism, as recited in claim 10, wherein said disconnect means comprises:

(f) a solenoid which restricts the thread directly;

(g) a circuit to deenergize said solenoid when detecting means detects a predetermined phase angle of main shaft; and (h) a circuit to energize said solenoid when the detecting means detects the rotation of the drawing roller corresponding to an operated stitch pitch.

14. A needle thread feeding mechanism, as recited in claim 10, in which said detecting means comprises:

(f) an encoder provided coaxially with the shaft of the roller;

(g) a potentiometer which detects the thickness of a workpiece;

(h) a micro computer having a central processing unit and a memory unit;

(i) a zigzag-width-signal-output device which outputs zigzag width to said central processing unit;

(j) a stitch-pitch-signal-output device which outputs a stitch pitch signal to said central processing unit;

(k) a main-shaft-phase-angle detector which detects phase angle of the main shaft; and (l) a circuit to operate a desired stitch pitch when said main-shaft-phase-angle detector detects a predetermined angle.

* * * * *